US010043468B2

(12) United States Patent
Wang

(10) Patent No.: US 10,043,468 B2
(45) Date of Patent: Aug. 7, 2018

(54) PIXEL CIRCUIT AND DRIVING METHOD THEREFOR, DISPLAY PANEL AND DISPLAY APPARATUS

(71) Applicants: BOE TECHNOLOGY GROUP CO., LTD., Beijing (CN); BEIJING BOE DISPLAY TECHNOLOGY CO., LTD., Beijing (CN)

(72) Inventor: Junwei Wang, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 15/519,957

(22) PCT Filed: Jul. 19, 2016

(86) PCT No.: PCT/CN2016/090396
§ 371 (c)(1),
(2) Date: Apr. 18, 2017

(87) PCT Pub. No.: WO2017/128645
PCT Pub. Date: Aug. 3, 2017

(65) Prior Publication Data

US 2018/0102101 A1 Apr. 12, 2018

(30) Foreign Application Priority Data

Jan. 27, 2016 (CN) ..... 2016 1 0055591

(51) Int. Cl.
*G09G 3/36* (2006.01)

(52) U.S. Cl.
CPC ..... *G09G 3/3648* (2013.01); *G09G 2330/028* (2013.01)

(58) Field of Classification Search
CPC ..... G09G 2360/14–2360/148
See application file for complete search history.

(56) References Cited

U.S. PATENT DOCUMENTS 7,286,192 B2 10/2007 Lin et al.
7,567,312 B2 7/2009 Lin et al.
(Continued)

FOREIGN PATENT DOCUMENTS

CN 101419350 A 4/2009
CN 102290023 A 12/2011
(Continued)

OTHER PUBLICATIONS

International Search report forms 210, 220, 237 dated Oct. 24, 2016 in corresponding International Application No. PCT/CN2016/090396 along with an English translation of the International Search Report and an English translation of the Written Opinion of the International Searching Authority.
(Continued)

*Primary Examiner* — Sanghyuk Park
(74) *Attorney, Agent, or Firm* — Nath, Goldberg & Meyer; Joshua B. Goldberg

(57) ABSTRACT

The present invention provides a pixel circuit and a driving method therefor, a display panel and a display apparatus, the pixel circuit comprises a data write device, a liquid crystal capacitor, a power supply device and a control signal output device, the data write device writes a data voltage of a data line to a first terminal of the liquid crystal capacitor in a normal display stage; the control signal output device acquires the data voltage and generates a corresponding charge control signal in accordance with the acquired data voltage in the normal display stage, and transmits the charge control signal to the power supply device in a static display stage; the power supply device charges the liquid crystal capacitor in accordance with the charge control signal, till the voltage difference between the first terminal and the second terminal of the liquid crystal capacitor becomes Vdata−Vcom.

15 Claims, 4 Drawing Sheets

(56) References Cited

U.S. PATENT DOCUMENTS

| | | | | |
|---|---|---|---|---|
| 8,823,624 | B2 | 9/2014 | Liu et al. | |
| 2002/0075205 | A1 | 6/2002 | Kimura et al. | |
| 2007/0257259 | A1* | 11/2007 | Chen | G09G 3/3648 257/59 |
| 2009/0102752 | A1 | 4/2009 | Honda | |
| 2012/0038604 | A1* | 2/2012 | Liu | G09G 3/3648 345/211 |
| 2012/0154369 | A1 | 6/2012 | Yamauchi | |
| 2013/0033473 | A1 | 2/2013 | Zebedee | |
| 2013/0141417 | A1 | 6/2013 | Chen | |
| 2013/0321492 | A1 | 12/2013 | Tanaka | |
| 2015/0348494 | A1* | 12/2015 | Lim | G09G 3/3648 345/211 |

FOREIGN PATENT DOCUMENTS

| | | | |
|---|---|---|---|
| CN | 102402960 | A | 4/2012 |
| CN | 102725788 | A | 10/2012 |
| CN | 103718237 | A | 4/2014 |
| CN | 105513553 | A | 4/2016 |
| JP | 2006-343733 | A | 12/2006 |
| TW | 548625 | B | 8/2003 |

OTHER PUBLICATIONS

Office Action dated Aug. 3, 2017 issued in corresponding Chinese Application No. 201610055591.1.

* cited by examiner

PIXEL CIRCUIT AND DRIVING METHOD THEREFOR, DISPLAY PANEL AND DISPLAY APPARATUS

This is a National Phase Application filed under 35 U.S.C. 371 as a national stage of PCT/CN2016/090396, filed Jul. 19, 2016, an application claiming the benefit of Chinese Application No. 201610055591.1, filed Jan. 27, 2016, the content of each of which is hereby incorporated by reference in its entirety.

FIELD

The present invention relates to a field of display technology, and particularly, to a pixel circuit and a driving method therefor, a display panel and a display apparatus.

BACKGROUND

A thin film transistor liquid crystal display (TFT-LCD) apparatus, as a flat panel display apparatus, is more and more widely used in the field of high performance display due to its characteristics such as small volume, low power consumption, no radiation and relatively low production cost.

An array substrate of a liquid crystal display apparatus comprises: a plurality of gate lines and a plurality of data lines, the gate line and the data line are intersect with each other; a plurality of pixel units defined by intersection of the data lines and the gate lines, the pixel units are arranged in a matrix. During a procedure of displaying of a frame of picture, the gate lines are generally scanned row by row from top to bottom by using a driving signal at a certain frequency, so that the pixel units are gated row by row. In this case, the gated pixel units are charged by the data lines, liquid crystal molecules are controlled to deflect at different angles, so that the picture is displayed.

During the procedure of displaying the picture on the liquid crystal display apparatus, there are generally two states: displaying a normal picture and displaying a static picture. During the procedure of displaying the normal picture, the liquid crystal display apparatus refreshes frame by frame to update a display content of the picture. During the procedure of displaying the static picture, the liquid crystal display apparatus also refreshes frame by frame, but the display content of the picture is constant.

As above, for the liquid crystal display apparatus of prior art, scanning signals of the gate lines for displaying the static picture have a charging frequency equal to that of scanning signals of the gate lines for displaying a dynamic picture, that is, maintaining a relatively high charging frequency, however, the higher the charging frequency of the gate lines is, the larger the overall power consumption of the liquid crystal display apparatus is. Thus, the liquid crystal display apparatus of prior art has a relatively large overall power consumption while displaying the static picture.

SUMMARY

An object of the present invention is to provide a pixel circuit and a driving method therefor, a display panel and a display apparatus for solving a problem that the liquid crystal display apparatus of prior art has a relatively large overall power consumption while displaying the static picture, which can effectively reduce power consumptions of the pixel circuit and the display panel.

In order to achieve the object mentioned above, the present invention provides a pixel circuit, comprising a data write device, a liquid crystal capacitor, a power supply device and a control signal output device, the data write device is connected to a gate line, a data line and a first terminal of the liquid crystal capacitor, a second terminal of the liquid crystal capacitor is connected to a common voltage line, the control signal output device is connected to the data line and the power supply device, the power supply device is connected to the first terminal and the second terminal of the liquid crystal capacitor; the data write device is configured to write a data voltage of the data line to the first terminal of the liquid crystal capacitor under the control of a gate scanning signal of the gate line in a normal display stage; the control signal output device is configured to acquire the data voltage that is provided by the data line to the pixel circuit and generate a corresponding charge control signal in accordance with the acquired data voltage in the normal display stage, and transmit the charge control signal to the power supply device in a static display stage; the power supply device is configured to charge the liquid crystal capacitor in accordance with the charge control signal, till a voltage difference between the first terminal and the second terminal of the liquid crystal capacitor becomes Vdata−Vcom, wherein, Vdata is a value of the data voltage, Vcom is a value of a common voltage output from the common voltage line.

Optionally, the power supply device comprises a first switch control device and a charge power supply, the charge control signal comprises a first control signal; the first switch control device is connected to the control signal output device, the first terminal and the second terminal of the liquid crystal capacitor, and a first electrode and a second electrode of the charge power supply; the first switch control device is configured to connect the first electrode of the charge power supply with the first terminal of the liquid crystal capacitor and connect the second electrode of the charge power supply with the second terminal of the liquid crystal capacitor under control of the first control signal, so as to forward charge the liquid crystal capacitor by the charge power supply, till the voltage difference between the first terminal and the second terminal of the liquid crystal capacitor becomes Vdata−Vcom; there is a constant voltage difference between the first electrode and the second electrode of the charge power supply.

Optionally, the first switch control device comprises a first transistor and a second transistor; a control electrode of the first transistor is connected to the control signal output device, a first electrode of the first transistor is connected to the first electrode of the charge power supply, a second electrode of the first transistor is connected to the first terminal of the liquid crystal capacitor; a control electrode of the second transistor is connected to the control signal output device, a first electrode of the second transistor is connected to the second electrode of the charge power supply, and the second electrode of the second transistor is connected to the second terminal of the liquid crystal capacitor.

Optionally, the power supply device further comprises a second switch control device, the charge control signal further comprises a second control signal; the second switch control device is connected to the control single output device, the first terminal and the second terminal of the liquid crystal capacitor, and the first electrode and the second electrode of the charge power supply; the second switch control device is configured to connect the first electrode of the charge power supply with the second terminal of the liquid crystal capacitor and connect the second electrode of the charge power supply with the first terminal of the liquid crystal capacitor under the control of the second control signal, so as to reverse charge the liquid crystal capacitor by the charge power supply, till the voltage difference between the first terminal and the second terminal of the liquid crystal capacitor becomes Vcom−Vdata.

Optionally, the second switch control device comprises a third transistor and a fourth transistor; a control electrode of the third transistor is connected to the control signal output device, a first electrode of the third transistor is connected to the first electrode of the charge power supply, a second electrode of the third transistor is connected to the second terminal of the liquid crystal capacitor; a control electrode of the fourth transistor is connected to the control signal output device, a first electrode of the fourth transistor is connected to the second electrode of the charge power supply, and the second electrode of the fourth transistor is connected to the first terminal of the liquid crystal capacitor.

Optionally, the control signal output device is configured to output the first control signal to the first switch control device and output the second control signal to the second switch control device alternatively.

Optionally, the power supply device further comprises a filter capacitor, a first terminal of the filter capacitor is connected to the first electrode of the charge power supply, and a second terminal of the filter capacitor is connected to the second electrode of the charge power supply.

Optionally, the charge power supply is a photocell.

Optionally, the data write device comprises a fifth transistor; a control electrode of the fifth transistor is connected to the gate line, a first electrode of the fifth transistor is connected to the data line, and a second electrode of the fifth transistor is connected to the first terminal of the liquid crystal capacitor.

Optionally, the data write device further comprises a storage capacitor; a first terminal of the storage capacitor is connected to the first terminal of the liquid crystal capacitor, and a second terminal of the storage capacitor is connected to the second terminal of the liquid crystal capacitor.

Optionally, the pixel circuit further comprises a switch device provided between the power supply device and the first terminal of the liquid crystal capacitor or provided between the power supply device and the second terminal of the liquid crystal capacitor; the switch device is configured to control electrical connection or electrical disconnection of the power supply device and the liquid crystal capacitor.

Optionally, the switch device comprises a sixth transistor; a control electrode of the sixth transistor is connected to a switch control signal line, a first electrode of the sixth transistor is connected to the power supply device; when the switch device is provided between the power supply device and the first terminal of the liquid crystal capacitor, a second electrode of the sixth transistor is connected to the first terminal of the liquid crystal capacitor; and when the switch device is provided between the power supply device and the second terminal of the liquid crystal capacitor, the second electrode of the sixth transistor is connected to the second terminal of the liquid crystal capacitor.

Optionally, the control signal output device comprises a data acquisition device and a signal output device; the data acquisition device is connected to the data line and the signal output device, the signal output device is connected to the power supply device; the data acquisition device is configured to acquire the data voltage provided by the data line to the pixel circuit; the signal output device is configured to inquire about the charge control signal corresponding to the data voltage in accordance with a pre-stored correspondence relationship table.

Optionally, all the transistors of the pixel circuit are n-type transistors.

In order to achieve the object said above, the present invention provides a display panel comprising the pixel circuit described above.

Optionally, the display panel is a reflective display panel.

In order to achieve the object said above, the present invention provides a display apparatus comprising the display panel described above.

In order to achieve the object said above, the present invention provides a driving method for driving the pixel circuit described above, the driving method comprises: in the normal display stage, the data write device writes the data voltage of the data line to the first terminal of the liquid crystal capacitor under the control of the gate scanning signal of the gate line, a common voltage signal is applied to the common voltage line to write the common voltage to the second terminal of the liquid crystal capacitor, the control signal output device acquires the data voltage that is provided by the data line to the pixel circuit and generates the corresponding charge control signal in accordance with the acquired data voltage; and in the static display stage, the gate line stops outputting the gate scanning signal, the common voltage line is stopped to be applied with the common voltage signal, the power supply device charges the liquid crystal capacitor in accordance with the charge control signal, till the voltage difference between the first terminal and the second terminal of the liquid crystal capacitor becomes Vdata−Vcom, wherein, Vdata is a value of the data voltage, and Vcom is a value of the common voltage.

Optionally, when the power supply device comprises the first switch control device and the second switch control device, the charge control signal comprises the first control signal and the second control signal; in the static display stage, the control signal output device outputs the second control signal to the second switch control device, the second switch control device connects the first electrode of the charge power supply with the second terminal of the liquid crystal capacitor and connects the second electrode of the charge power supply with the first terminal of the liquid crystal capacitor under the control of the second control signal, so that the charge power supply reverse charges the liquid crystal capacitor, till the voltage difference between the first terminal and the second terminal of the liquid crystal capacitor becomes Vcom−Vdata; the control signal output device outputs the first control signal to the first switch control device, the first switch control device connects the first electrode of charge power supply with the first terminal of the liquid crystal capacitor and connects the second electrode of the charge power supply with the second terminal of the liquid crystal capacitor under the control of the first control signal, so that the charge power supply forward charges the liquid crystal capacitor, till the voltage difference between the first terminal and the second terminal of the liquid crystal capacitor becomes Vdata−Vcom; the control signal output device outputs the second control signal to the second switch control device and outputs the first control signal to the first switch control device alternatively.

The present invention provides the pixel circuit and the driving method therefor, the display panel comprising the pixel circuit and the display apparatus comprising the display panel, wherein, the pixel circuit comprises the data write device, the liquid crystal capacitor, the power supply device and the control signal output device, the data write device is configured to write the data voltage of the data line to the first terminal of the liquid crystal capacitor under the control of the gate scanning signal of the gate line in a normal display stage; the control signal output device is configured to acquire the data voltage that is provided by the data line to the pixel circuit and generate the corresponding charge control signal in accordance with the acquired data voltage in the normal display stage, and transmit the charge control signal to the power supply device in the static display stage; the power supply device is configured to charge the liquid crystal capacitor in accordance with the charge control signal, till the voltage difference between the first terminal and the second terminal of the liquid crystal capacitor becomes Vdata−Vcom. By providing the power supply device and the control signal output device in the pixel circuit of the present invention, the liquid crystal capacitor is charged in the static display stage, at this time, there is no need to apply the scanning signal to the gate line, thereby the overall power consumption of the display panel is effectively reduced.

DETAILED DESCRIPTION OF THE EMBODIMENTS

In order to make a person skilled in the art understand technical solutions of the present invention better, the pixel circuit and the driving method therefor, the display panel and the display apparatus provided by the present invention will be described in detail below in conjunction with accompanying drawings.

Figure 1:
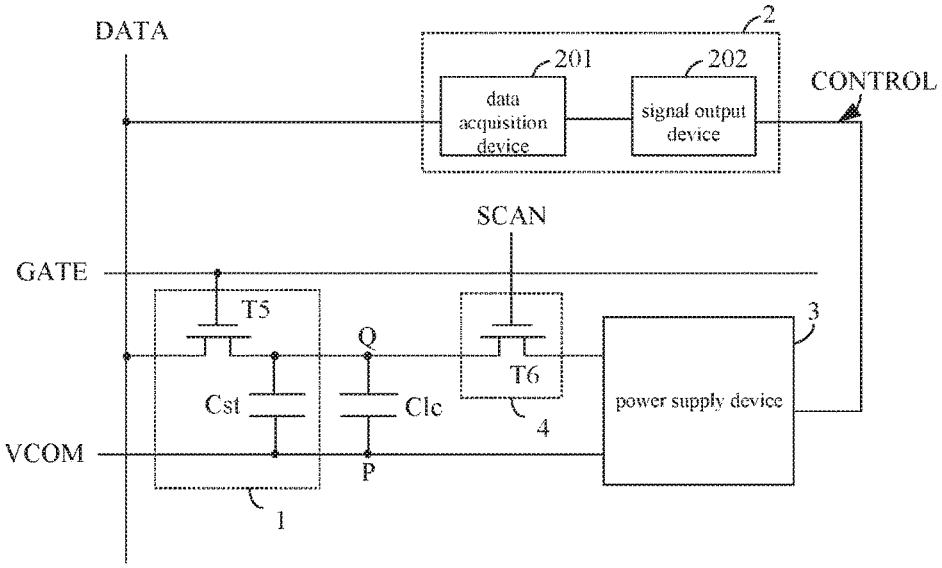
FIG. 1 shows a circuit structure diagram of a pixel circuit in accordance with a first embodiment of the present invention.

FIG. 1 shows a circuit structure diagram of a pixel circuit in accordance with a first embodiment of the present invention. As shown in FIG. 1, the pixel circuit comprises a data write device 1, a liquid crystal capacitor C1*c*, a power supply device 3 and a control signal output device 2.

In the embodiment, the data write device 1 is connected to a gate line GATE, a data line DATA and a first terminal Q of the liquid crystal capacitor C1*c*, for writing a data voltage of the data line DATA to the first terminal Q of the liquid crystal capacitor C1*c* under the control of a gate scanning signal of the gate line GATE in a normal display stage.

The liquid crystal capacitor C1*c* has a second terminal P connected to a common voltage line VCOM, for generating a corresponding electric field when a voltage is applied across it, so as to control liquid crystal molecules to deflect at a corresponding angle.

The control signal output device 2 is connected to the data line DATA and the power supply device 3, for acquiring the data voltage that is provided by the data line DATA to the pixel circuit and generating a corresponding charge control signal in accordance with the acquired data voltage in the normal display stage, and transmitting the charge control signal to the power supply device 3 in a static display stage.

The power supply device 3 is connected to the first terminal Q and the second terminal P of the liquid crystal capacitor C1*c*, for charging the liquid crystal capacitor C1*c* in accordance with the charge control signal, till a voltage difference between the first terminal Q and the second terminal P of the liquid crystal capacitor C1*c* becomes Vdata−Vcom. Vdata is a value of the data voltage, Vcom is a value of a common voltage output from the common voltage line VCOM.

Figure 2:
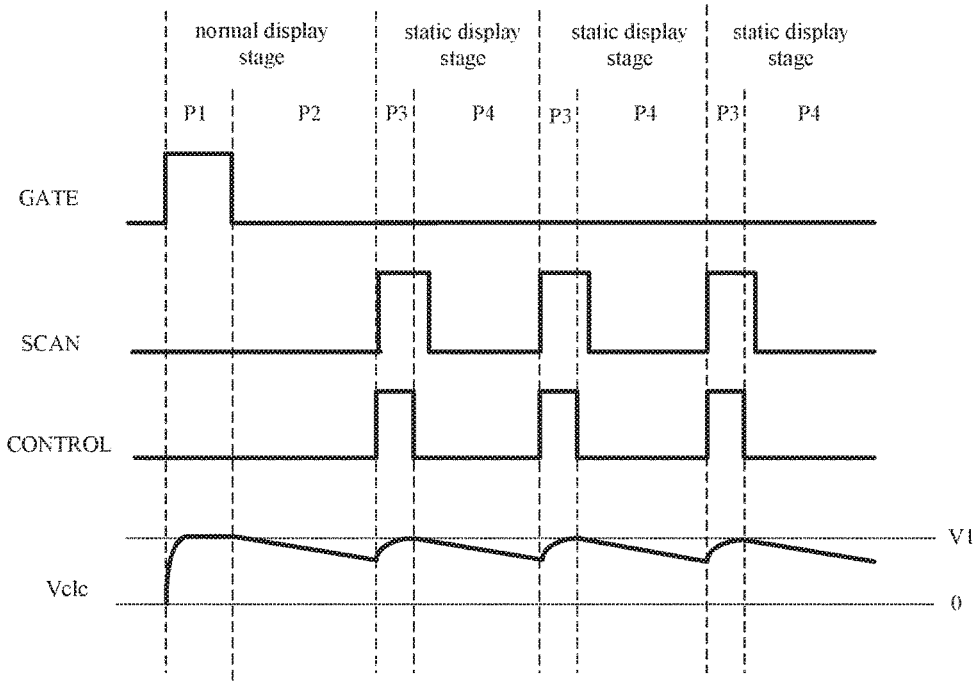
FIG. 2 shows an operational timing diagram of the pixel circuit of FIG. 1.

In order to make a person skilled in the art understand the present invention better, technical solutions of the present invention will be described below in conjunction with the accompanying drawings. FIG. 2 shows an operational timing diagram of the pixel circuit of FIG. 1. As shown in FIG. 2, the pixel circuit has two operational stages: the normal display stage and the static display stage.

The normal display stage specifically comprises: a data write procedure P1 and a normal display procedure P2. Specifically, during the data write procedure P1, the gate line GATE outputs the gate scanning signal and the gate scanning signal is at a high level, the data write device 1 writes the data voltage of the data line DATA to the first terminal Q of the liquid crystal capacitor C1*c* under the control of the gate scanning signal. The common voltage is applied to the common voltage line VCOM and is written to the second terminal P of the liquid crystal capacitor C1*c*. At this time, the voltage difference between the two terminals of the liquid crystal capacitor C1*c* (i.e., the voltage difference between the first terminal Q and the second terminal P) Vc1*c*=Vdata−Vcom. Suppose that a value of Vdata−Vcom is V1, the pixel circuit presents a corresponding gray scale, the gray scale presented by the pixel circuit is updated (for a whole display panel, the picture displayed by the display panel is updated). During the normal display procedure P2, the gate scanning signal is at a low level, the liquid crystal capacitor C1*c* maintains the pixel circuit to perform a display, but the voltage difference Vc1*c* between the two terminals of the liquid crystal capacitor C1*c* will continue to reduce due to a leakage current, that is, a voltage drop is generated by the liquid crystal capacitor C1*c*.

It should be noted that, in practical applications, the normal display procedure P2 is designed to be a constant time duration, and it should satisfied that, in this constant time duration, a change of the gray scale presented by the pixel circuit due to the voltage drop generated by the liquid crystal capacitor C1*c* cannot be recognized by human's eyes, that is, the change of the gray scale due to the voltage drop does not exceed the minimum recognition ability of human's eyes. The constant time duration may be determined in accordance with practical experiences. In the present invention, the constant time duration may be 1/30 s.

In addition, during the normal display procedure P2, for different data voltages, the voltage drops generated by the liquid crystal capacitor C1*c* are different from each other. In the present invention, the corresponding voltage drops generated by the liquid crystal capacitor C1*c* during the normal display procedure P2 when the data voltages of respective gray scales are applied to the first terminal Q of the liquid crystal capacitor C1*c* may be acquired by performing experiments in advance, and a one-to-one correspondence relationship between the data voltages and the voltage drops generated by the liquid crystal capacitor C1*c* may be established.

Simultaneously, the control signal output device 2 acquires the data voltage provided by the data line DATA to the pixel circuit, and generates the corresponding charge control signal in accordance with the acquired data voltage.

It should be noted that, for different data voltages, different voltage drops are generated by the liquid crystal capacitor C1*c*, thus during a following procedure of compensating the voltage difference Vc1*c* between the two terminal of the liquid crystal capacitor C1*c* to Vdata−Vcom, the liquid crystal capacitor C1*c* needs to be charged by the power supply device 3 at different charge quantities. Correspondingly, the control signal output device 2 transmits different charge control signals to the power supply device 3. In view of this, a one-to-one correspondence relationship table storing the data voltages and the charge control signals corresponding to the data voltages respectively may be stored in the control signal output device 2.

The static display stage specifically comprises: a charge compensation procedure P3 and a static display procedure P4. Specifically, during the charge compensation procedure P3, the gate line GATE stops outputting the gate scanning signal, the common voltage line VCOM is stopped to be applied with the common voltage signal and is in a floating state. At this time, the control signal output device 2 outputs the corresponding charge control signal to the power supply device 3, the power supply device 3 charges the liquid crystal capacitor C1*c* in accordance with the charge control signal so that the voltage difference between the first terminal Q and the second terminal P of the liquid crystal capacitor C1*c* is back to Vdata−Vcom. During the static display procedure P4, the power supply device 3 stops charging the liquid crystal capacitor C1*c*, the liquid crystal capacitor C1*c* maintains the pixel circuit to perform the display, but the voltage difference Vc1*c* between the two terminals of the liquid crystal capacitor C1*c* will continue to reduce again due to the leakage current, that is, a voltage drop is generated by the liquid crystal capacitor C1*c*. When the time duration of the static display procedure P4 is the same as that of the normal display procedure P2, the voltage drops generated by the liquid crystal capacitor C1*c* are also the same.

In following procedures, the charge compensation procedure P3 and the static display procedure P4 are repeated, that is, every preset time (a time from a start of a charging to a start of a next charging), the power supply device 3 charges the liquid crystal capacitor C1*c* once, so that the pixel circuit performs a static displaying. In practical applications, a time of one charge compensation procedure for charging the liquid crystal capacitor C1*c* by the power supply device 3 is much less than a time of one static display procedure, thus the said preset time may be approximately equal to the time of one static display procedure P4, and also approximately equal to a time corresponding to the normal display procedure P2. Specifically, the preset time may be 1/30 s.

As above, in the static display stage of the pixel circuit of the present invention, there is no need to scan (charge) the gate line GATE, thereby the overall power consumption of the display panel can be effectively reduced.

Optionally, the data write device 1 comprises a fifth transistor T5; a control electrode of the fifth transistor T5 is connected to the gate line GATE, a first electrode of the fifth transistor T5 is connected to the data line DATA, and a second electrode of the fifth transistor T5 is connected to the first terminal Q of the liquid crystal capacitor C1*c*. By taking the fifth transistor T5 being an n-type transistor as an example, when the gate scanning signal is at the high level, the fifth transistor T5 is turned on, a data signal is written to the first terminal Q of the liquid crystal capacitor C1*c* through the fifth transistor T5.

Further optionally, the data write device 1 further comprises a storage capacitor Cst; a first terminal of the storage capacitor Cst is connected to the first terminal Q of the liquid crystal capacitor C1*c*, and a second terminal of the storage capacitor Cst is connected to the second terminal P of the liquid crystal capacitor C1*c*. In the present invention, by providing the storage capacitor Cst, a falling speed of the voltage difference between the two terminals of the liquid crystal capacitor C1*c* is effectively reduced, and in this case, during the static display stage, an interval for performing the charge compensation to the liquid crystal capacitor C1*c* by the power supply device 3 can be increased effectively, reducing charging times per device time, thereby the power consumption of the pixel circuit in the static display stage is effectively reduced, and the overall power consumption of the display panel is correspondingly reduced.

Optionally, the control signal output device 2 comprises a data acquisition device 201 and a signal output device 202. The data acquisition device 201 is connected to the data line DATA and the signal output device 202. The signal output device 202 is connected to the power supply device 3. The data acquisition device 201 is configured to acquire the data voltage provided by the data line DATA to the pixel circuit. The signal output device 202 is configured to inquire about the charge control signal corresponding to the data voltage in accordance with a pre-stored correspondence relationship table.

Optionally, the pixel circuit further comprises a switch device 4 provided between the power supply device 3 and the first terminal Q of the liquid crystal capacitor C1*c* or provided between the power supply device 3 and the second terminal P of the liquid crystal capacitor C1*c*. The switch device 4 is configured to control connection or disconnection between the power supply device 3 and the liquid crystal capacitor C1*c*. when the switch device 4 is turned on, the power supply device 3 can charge the liquid crystal capacitor C1*c*. Otherwise, the power supply device 3 cannot charge the liquid crystal capacitor C1*c*.

Further optionally, the switch device 4 comprises a sixth transistor T6, a control electrode of the sixth transistor T6 is connected to a switch control signal line SCAN, a first electrode of the sixth transistor T6 is connected to the power supply device 3. When the switch device 4 is provided between the power supply device 3 and the first terminal Q of the liquid crystal capacitor C1*c*, a second electrode of the sixth transistor T6 is connected to the first terminal Q of the liquid crystal capacitor C1*c*. When the switch device 4 is provided between the power supply device 3 and the second terminal P of the liquid crystal capacitor C1*c*, the second electrode of the sixth transistor T6 is connected to the second terminal P of the liquid crystal capacitor C1*c*.

It should be noted that, FIG. 1 only shows an example in which the switch device 4 is provided between the power supply device 3 and the first terminal Q of the liquid crystal capacitor C1*c*, the case that the switch device 4 is provided between the power supply device 3 and the second terminal P of the liquid crystal capacitor C1*c* is not shown by the drawings.

In practical applications, the control signal output device 2 is generally integrated in a chip of the display panel (located in peripheral region of the display panel), and the power supply device 3 is directly provided in a pixel unit, in this case, a corresponding signal lead wire CONTROL should be provided in the display panel so as to transmit the charge control signal output from the control signal output device 2 to the power supply device 3. Since each pixel circuit should be provided with a single signal lead wire CONTROL, a wiring quantity of the display panel is increased.

In order to solve the problem mentioned above, in technical solutions of the present invention, by providing the switch device 4 in the pixel circuit, one signal lead wire CONTROL may correspond to a plurality of pixel circuits (for example, a column of pixel circuits in the display panel). Specifically, when there is a need to transmit the charge control signal to a certain target pixel circuit by the signal lead wire CONTROL, the switch device 4 in the target pixel circuit is turned on, but the switch device 4 in any of other pixel circuits is turned off, the power supply device 3 in the target pixel circuit can charge the liquid crystal capacitor C1*c* through the switch device 4 in accordance with the charge control signal, since the switch device 4 in any of other pixel circuits is turned off, the power supply device 3 in any of other pixel circuits cannot charge the liquid crystal capacitor C1*c* even if the power supply device 3 also receives the charge control signal.

Figure 3:
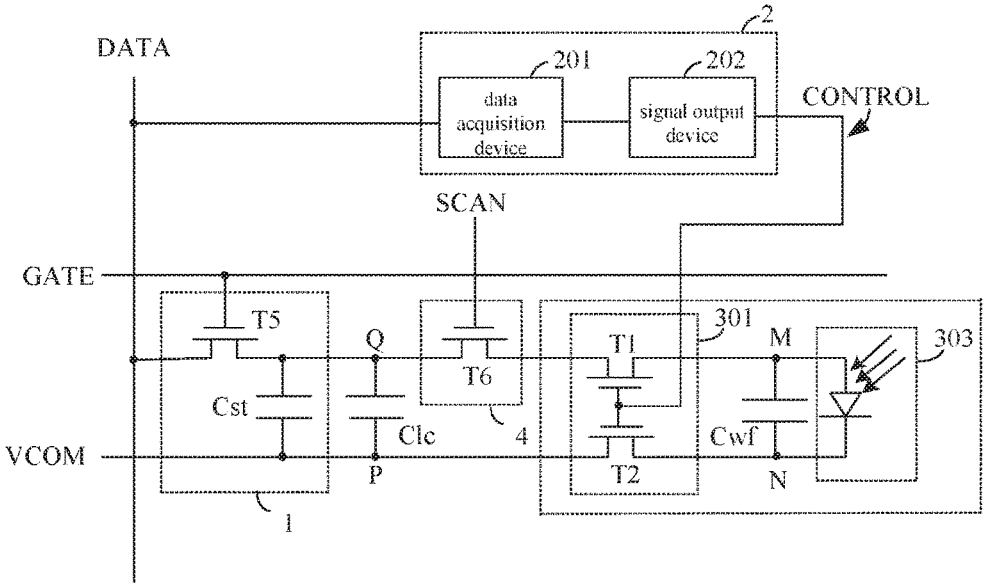
FIG. 3 shows a circuit structure diagram of a pixel circuit in accordance with a second embodiment of the present invention.

FIG. 3 shows a circuit structure diagram of a pixel circuit in accordance with a second embodiment of the present invention. As shown in FIG. 3, the pixel circuit shown in FIG. 3 is a specific implementation of the pixel circuit of FIG. 1. Specifically, the power supply device 3 comprises a first switch control device 301 and a charge power supply 303, the charge control signal comprises a first control signal. The first switch control device 301 is connected to the control signal output device 2, the first terminal Q and the second terminal P of the liquid crystal capacitor C1*c*, and a first electrode M and a second electrode N of the charge power supply 303. The first switch control device 301 is configured to electrically connect the first electrode M of the charge power supply 303 with the first terminal Q of the liquid crystal capacitor C1*c* and electrically connect the second electrode N of the charge power supply 303 with the second terminal P of the liquid crystal capacitor C1*c* under the control of the first control signal, so as to forward charge the liquid crystal capacitor C1*c* by the charge power supply 303, till the voltage difference between the first terminal Q and the second terminal P of the liquid crystal capacitor C1*c* becomes Vdata−Vcom. There is a constant voltage difference between the first electrode M and the second electrode N of the charge power supply 303, and the constant voltage difference is larger than a maximum value of the data voltage.

Further optionally, the first switch control device 301 comprises a first transistor T1 and a second transistor T2. A control electrode of the first transistor T1 is connected to the control signal output device 2, a first electrode of the first transistor T1 is connected to the first electrode M of the charge power supply 303, a second electrode of the first transistor T1 is connected to the first terminal Q of the liquid crystal capacitor C1*c*. A control electrode of the second transistor T2 is connected to the control signal output device 2, a first electrode of the second transistor T2 is connected to the second electrode N of the charge power supply 303, and the second electrode of the second transistor T2 is connected to the second terminal P of the liquid crystal capacitor C1*c*.

The operational timing diagram of the pixel circuit shown in FIG. 3 has been shown in FIG. 2, and the specific operation procedure has been described in the first embodiment, and will not be repeated here.

The principle of charging the liquid crystal capacitor C1*c* by the power supply device 3 in the present embodiment will be described below in conjunction with the drawings. Suppose that the first transistor T1, the second transistor T2 and the sixth transistor T6 are n-type transistors, the first electrode M of the charge power supply 303 is a positive electrode, and the second electrode N of the charge power supply 303 is a negative electrode.

Referring to FIG. 2, during the charge compensation procedure of the static display stage, the charge control signal is at the high level, thus the first transistor T1 and the second transistor T2 are turned on. Simultaneously, the switch control signal of the switch control line is also at the high level. At this time, the first electrode M of the charge power supply 303 is connected to the first terminal Q of the liquid crystal capacitor C1*c*, the second electrode N of the charge power supply 303 is connected to the second terminal P of the liquid crystal capacitor C1*c*, that is, an electrical connection is established between the charge power supply 303 and the liquid crystal capacitor C1*c* (the liquid crystal capacitor C1*c* may be regarded as a load in the circuit), the charge power supply 303 forward charges the liquid crystal capacitor C1*c*, so that the voltage difference Vc1*c* between the first terminal Q and the second terminal P of the liquid crystal capacitor C1*c* increases gradually with an increase of charging time, till the voltage difference between the first terminal Q and the second terminal P of the liquid crystal capacitor C1*c* becomes Vdata−Vcom.

It should be noted that, the time for forward charging the liquid crystal capacitor C1*c* by the charge power supply 303 may be controlled by adjusting a duty ratio of the charge control signal, specifically, the time during which the charge control signal is at the high level corresponds to the time for forward charging.

Optionally, the power supply device 303 further comprises a filter capacitor Cwf, a first terminal of the filter capacitor Cwf is connected to the first electrode M of the charge power supply 303, and a second terminal of the filter capacitor Cwf is connected to the second electrode N of the charge power supply 303. By providing the filter capacitor Cwf between two terminals of the charge power supply 303, the charge power supply 303 has a stable output, thus ensuring an accuracy of charge quantity for charging the liquid crystal capacitor C1*c*.

Optionally, the charge power supply 303 is a photocell. In this case, the pixel circuit of the present embodiment is a pixel circuit in a reflective display panel, the photocell may be charged by external light so that the photocell maintains the display panel to display a static picture, thereby the overall consumption of the display panel is reduced.

Figure 4:
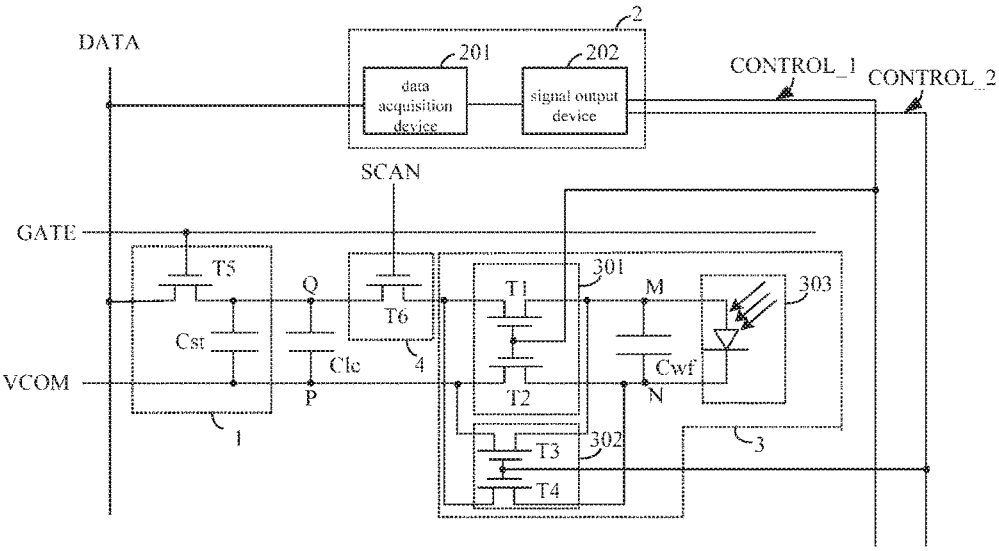
FIG. 4 shows a circuit structure diagram of a pixel circuit in accordance with a third embodiment of the present invention.

FIG. 4 shows a circuit structure diagram of a pixel circuit in accordance with a third embodiment of the present invention, as shown in FIG. 4, compared with the pixel circuit of FIG. 3, in the pixel circuit of FIG. 4, the power supply device 3 not only comprises the first switch control device 301 and the charge power supply 303, but also comprises a second switch control device 302. In addition, the charge control signal comprises the first control signal and a second control signal.

The second switch control device 302 is connected to the control single output device 2, the first terminal Q and the second terminal P of the liquid crystal capacitor C1*c*, and the first electrode M and the second electrode N of the charge power supply 303. The second switch control device 302 is configured to electrically connect the first electrode M of the charge power supply 303 with the second terminal P of the liquid crystal capacitor C1*c* and electrically connect the second electrode N of the charge power supply 303 with the first terminal Q of the liquid crystal capacitor C1*c* under the control of the second control signal, so as to reverse charge the liquid crystal capacitor C1*c* by the charge power supply 303, till the voltage difference Vc1*c* between the first terminal Q and the second terminal P of the liquid crystal capacitor C1*c* becomes Vcom−Vdata.

Further optionally, the second switch control device 302 comprises a third transistor T3 and a fourth transistor T4. A control electrode of the third transistor T3 is connected to the control signal output device 2, a first electrode of the third transistor T3 is connected to the first electrode M of the charge power supply 303, a second electrode of the third transistor T3 is connected to the second terminal P of the liquid crystal capacitor C1*c*. A control electrode of the fourth transistor T4 is connected to the control signal output device 2, a first electrode of the fourth transistor T4 is connected to the second electrode N of the charge power supply 303, and the second electrode of the fourth transistor T4 is connected to the first terminal Q of the liquid crystal capacitor C1*c*.

In addition, the control signal output device 2 is configured to output the first control signal to the first switch control device 301 and output the second control signal to the second switch control device 302 alternatively.

The operation procedure of the pixel circuit in the present embodiment will be described in detail below in conjunction with the drawings. Suppose that the first transistor T1, the second transistor T2, the third transistor T3, the fourth transistor T4, the fifth transistor T5 and the sixth transistor T6 in FIG. 4 are n-type transistors, the first electrode M of the charge power supply 303 is the positive electrode, the second electrode N of the charge power supply 303 is the negative electrode. The control signal output device 2 outputs the first control signal to the control electrodes of the first transistor T1 and the second transistor T2 through the first control signal line CONTROL_1, and outputs the second control signal to the control electrodes of the third transistor T3 and the second transistor T4 through the second control signal line CONTROL_2.

Figure 5:
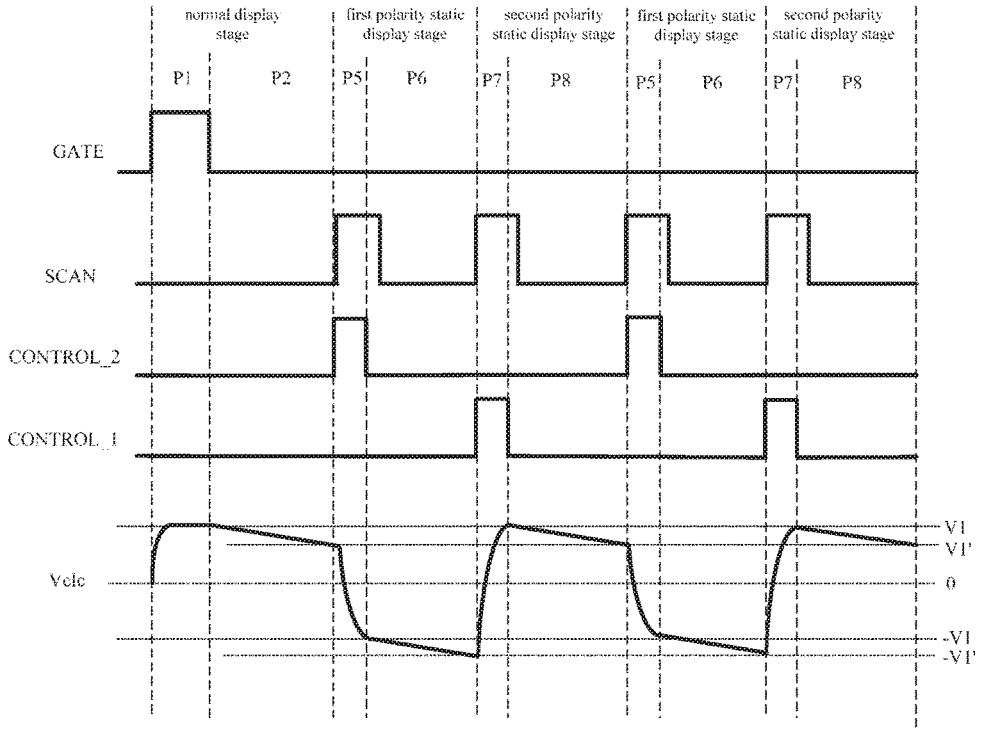
FIG. 5 shows an operational timing diagram of the pixel circuit of FIG. 4.

FIG. 5 shows an operational timing diagram of the pixel circuit of FIG. 4. As shown in FIG. 5, the pixel circuit has three operation stages: a normal display stage, a first polarity static display stage, and a second polarity static display stage.

The normal display stage comprises the data write procedure P1 and the normal display procedure P2, and the time duration of the data write procedure P1 is much less than the time duration of the normal display procedure P2.

Specifically, during the data write procedure P1, the gate line GATE outputs the gate scanning signal at the high level, the fifth transistor T5 is turned on, the data voltage of the data line DATA is written to the first terminal Q of the liquid crystal capacitor C1*c* through the fifth transistor T5. The common voltage is applied to the common voltage line VCOM and is written to the second terminal P of the liquid crystal capacitor C1*c*. At this time, the voltage difference between the two terminals of the liquid crystal capacitor C1*c* Vc1*c*=Vdata−Vcom. Suppose that the value of Vdata−Vcom is V1, the pixel circuit presents the corresponding gray scale, the gray scale presented by the pixel circuit is updated.

During the normal display procedure P2, the gate scanning signal of the gate line GATE is at the low level, the fifth transistor T5 is turned off. The liquid crystal capacitor C1*c* maintains the pixel circuit to perform the display, but the voltage difference Vc1*c* between the two terminals of the liquid crystal capacitor C1*c* will continue to reduce due to the leakage current, that is, a voltage drop is generated by the liquid crystal capacitor C1*c*. The time duration of the normal display procedure P2 is a preset constant time, for example, 1/30 s. At the end of the normal display procedure P2, the voltage difference Vc1*c* between the two terminals of the liquid crystal capacitor C1*c* may fall to V1' (which may be obtained by experiments in advance).

It should be noted that, during the whole normal display stage, the first control signal line CONTROL_1, the second control signal line CONTROL_2 and the switch control signal line SCAN are in the floating state, that is, at the low level. Correspondingly, the first transistor T1, the second transistor T2, the third transistor T3, the fourth transistor T4, the sixth transistor T6 are turned off.

The first polarity static display stage specifically comprises a first polarity charge compensation procedure P5 and a first polarity static display procedure P6.

During the first polarity charge compensation procedure P5, the gate line GATE and the common voltage line VCOM are in the floating state, the fifth transistor T5 is maintained to be turned off. At this time, the first control signal line CONTROL_1 is still in the floating state, the first transistor T1 and the second transistor T2 are maintained to be turned off. The control signal output device 2 outputs the second control signal through the second control signal line CONTROL_2, and the second control signal is at the high level, the third transistor T3 and the fourth transistor T4 are turned on. Simultaneously, a switch control signal (a scanning signal) is loaded to the switch control signal line SCAN, the switch control signal is at the high level, and the sixth transistor T6 is turned on.

Since the third transistor T3, the fourth transistor T4 and the sixth transistor T6 are turned on, the first electrode M of the charge power supply 303 is electrically connected to the second terminal P of the liquid crystal capacitor C1*c*, the second electrode N of the charge power supply 303 is electrically connected to the first terminal Q of the liquid crystal capacitor C1*c*, the charge power supply 303 reverse charges the liquid crystal capacitor C1*c*, so that the voltage difference between the first terminal Q and the second terminal P of the liquid crystal capacitor C1*c* is gradually reduced with the increase of the charging time, till the voltage difference between the first terminal Q and the second terminal P of the liquid crystal capacitor C1*c* Vc1*c*=Vcom−Vdata=−V1. The polarity of the liquid crystal molecules corresponding to the pixel circuit is reversed, but the gray scale presented by the pixel circuit remains unchanged.

It should be noted that, the time for reverse charging the liquid crystal capacitor C1*c* by the charge power supply 303 so that the voltage difference Vc1*c* between the two terminals of the liquid crystal capacitor C1*c* is reduced from V1' to V1 may be obtained in advance by experiments, correspondingly, the time for the second control signal being at the high level may also be predetermined.

During the first polarity static display procedure P6, the second control signal output from the second control signal line CONTROL_2 is at the low level, the third transistor T3 and the fourth transistor T4 are turned off. The switch control signal of the switch control signal line SCAN is switched from the high level to the low level at a certain time. The liquid crystal capacitor C1*c* maintains the pixel circuit to perform the display, but the voltage difference Vc1*c* between the two terminals of the liquid crystal capacitor C1*c* will be reduced continuously due to the leakage current. The time duration of the first polarity static display procedure P6 is approximately equal to that of the normal display procedure P2. At the end of the first polarity static display procedure, the voltage difference between the two terminals of the liquid crystal capacitor C1*c* may be reduced to −V1' (which may be obtained by experiments in advance).

The second polarity static display stage specifically comprises: a second polarity charge compensation procedure P7 and a second polarity static display procedure P8.

During the second polarity charge compensation procedure P7, the gate line GATE and the common voltage line VCOM are in the floating state, the fifth transistor T5 is maintained to be turned off. At this time, the second control signal line CONTROL_2 is in the floating state, the third transistor T3 and the fourth transistor T4 are maintained to be turned off. The control signal output device 2 outputs the first control signal through the first control signal line CONTROL_1, and the first control signal is at the high level, the first transistor T1 and the second transistor T2 are turned on. Simultaneously, the switch control signal of the switch control signal line SCAN is at the high level, the sixth transistor T6 is turned on.

Since the first transistor T1, the second transistor T2 and the sixth transistor T6 are turned on, the first electrode M of the charge power supply 303 is electrically connected to the first terminal Q of the liquid crystal capacitor C1*c*, the second electrode N of the charge power supply 303 is electrically connected to the second terminal P of the liquid crystal capacitor C1*c*, the charge power supply 303 forward charges the liquid crystal capacitor C1*c*, so that the voltage difference between the first terminal Q and the second terminal P of the liquid crystal capacitor C1*c* increases gradually with the increase of the charging time, till the voltage difference between the first terminal Q and the second terminal P of the liquid crystal capacitor C1*c* Vc1*c*=Vdata−Vcom=V1. The polarity of the liquid crystal molecules corresponding to the pixel circuit is reversed again, but the gray scale presented by the pixel circuit remains unchanged.

It should be noted that, the time for forward charging the liquid crystal capacitor C1*c* by the charge power supply 303 so that the voltage difference Vc1*c* between the two terminals of the liquid crystal capacitor C1*c* is increased from −V1' to V1 may be obtained in advance by experiments, that is, the time for the first control signal being at the high level may also be predetermined.

During the second polarity static display procedure P8, the first control signal output from the first control signal line CONTROL_1 is at the low level, the first transistor T1 and the second transistor T2 are turned off. The switch control signal of the switch control signal line SCAN is switched from the high level to the low level at a certain time. The liquid crystal capacitor C1*c* maintains the pixel circuit to perform the display, but the voltage difference Vc1*c* between the two terminals of the liquid crystal capacitor C1*c* will be reduced continuously due to the leakage current. The time duration of the second polarity static display procedure P8 is approximately equal to that of the normal display procedure P2. At the end of the second polarity static display procedure, the voltage difference Vc1*c* between the two terminals of the liquid crystal capacitor C1*c* is reduced to −V1' again.

It should be noted that, in the present embodiment, the periods of the switch control signal, the first control signal and the second control signal are equal to each other, and are approximately equal to the time duration of the normal display procedure P2. Optionally, all the periods of the switch control signal, the first control signal and the second control signal are 1/30 s.

In following display procedures, the control signal output device 2 alternatively outputs the second control signal and the first control signal, so as to alternatively proceed in the first polarity static display stage and the second polarity static display stage, till the picture displayed by the display panel needs to be updated.

Compared with the pixel circuits provided by the first embodiment and the second embodiment, the pixel circuit of the present embodiment can achieve a reversal of pixel polarity, thereby a polarization of liquid crystal is effectively avoided.

It should be noted that, in the present embodiment, during the static display procedure, although the switch control signal line SCAN needs to be charged repeatedly to provide the switch control signal, resulting in a certain power consumption, since the frequency (less than or equal to 30 Hz) of the switch control signal is less than the frequency (generally, 30 Hz) of the gate scanning signal in the prior art, the pixel circuit of the present invention has a lower power consumption than that of prior art.

It should be supplemented that, the present embodiment is only shown by taking the first transistor T1, the second transistor T2, the third transistor T3, the fourth transistor T4, the fifth transistor T5 and the sixth transistor T6 being n-type transistors as a preferred implementation, in this case, the transistors may be manufactured simultaneously by a single production process, resulting in a reduction of production processes, the production cycle is shortened. It should be understood for persons skilled in the art that, technical solutions obtained by modifying the type of the transistors and correspondingly modifying the output signals of the control lines to achieve the procedures of the above stages also fall into the protection scope of the present invention.

In addition, in the present invention, the control electrodes of the transistors are gates of the transistors, the first electrodes and the second electrodes of the transistors are sources and drains of the transistors respectively. When the first electrode is the source of the transistor, the second electrode is the drain of the transistor, and when the first electrode is the drain of the transistor, the second electrode is the source of the transistor.

A fourth embodiment of the present invention provides a display panel comprising a plurality of gate lines and a plurality of data lines, the gate lines and the data lines are intersect with each other, and the gate lines and the data lines define a plurality of pixel units, each of the pixel units is provided with the pixel circuit of any of the first through third embodiments, the corresponding descriptions have been given in the first through third embodiments, and will not be repeated here.

Optionally, the display panel is a reflective display panel, and when the pixel circuit comprises the photocell, the photocell may be charged by external light, so that the power consumption of the display panel is reduced.

A fifth embodiment of the present invention provides a display apparatus comprising the display panel of the fourth embodiment, the corresponding descriptions have been given in the fourth embodiment, and will not be repeated here.

Figure 6:
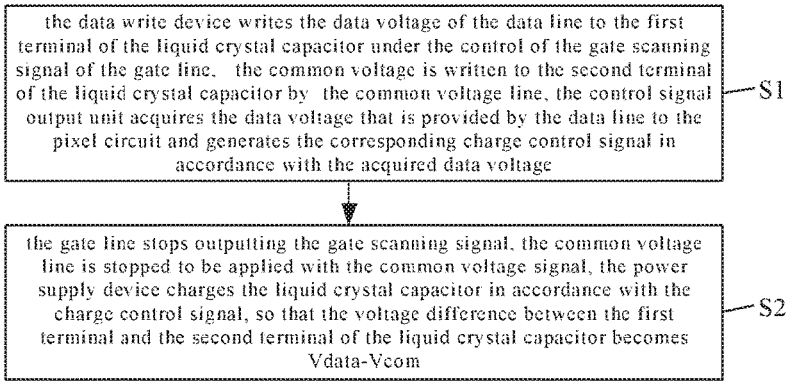
FIG. 6 shows a flow chart of a driving method for driving a pixel circuit in accordance with a sixth embodiment of the present invention.

FIG. 6 shows a flow chart of a driving method for driving a pixel circuit in accordance with a sixth embodiment of the present invention, and as shown in FIG. 6, the pixel circuit may be that of the first or second embodiment, and the driving method comprises steps of:

S1, in the normal display stage, the data write device writes the data voltage of the data line to the first terminal of the liquid crystal capacitor under the control of the gate scanning signal of the gate line, a common voltage signal is applied to the common voltage line to write the common voltage to the second terminal of the liquid crystal capacitor, the control signal output device acquires the data voltage that is provided by the data line to the pixel circuit and generates the corresponding charge control signal in accordance with the acquired data voltage; and S2, in the static display stage, the gate line stops outputting the gate scanning signal, the common voltage line is stopped to be applied with the common voltage signal, the power supply device charges the liquid crystal capacitor in accordance with the charge control signal, so that the voltage difference between the first terminal and the second terminal of the liquid crystal capacitor becomes Vdata−Vcom, wherein, Vdata is the value of the data voltage, and Vcom is the value of the common voltage.

It should be noted that, the corresponding descriptions of specific procedures of the steps S1 and S2 have been given in the first embodiment, and will not be repeated here.

Figure 7:
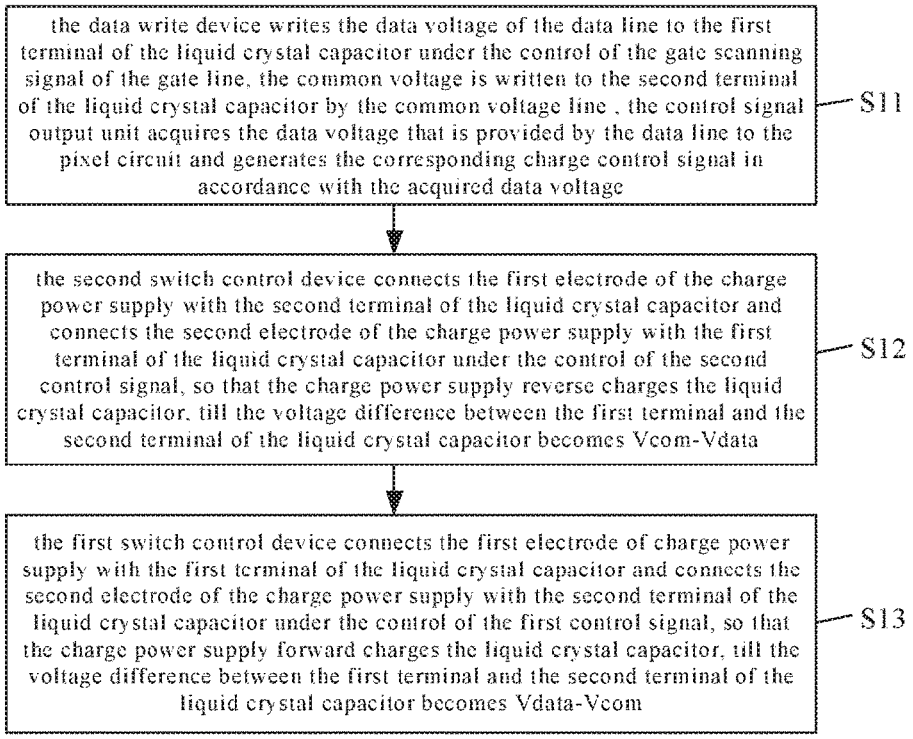
FIG. 7 shows a flow chart of a driving method for driving a pixel circuit in accordance with a seventh embodiment of the present invention.

FIG. 7 shows a flow chart of a driving method for driving a pixel circuit in accordance with a seventh embodiment of the present invention, and as shown in FIG. 7, the pixel circuit is that of the third embodiment, and the driving method comprises steps of:

S11, in the normal display stage, the data write device writes the data voltage of the data line to the first terminal of the liquid crystal capacitor under the control of the gate scanning signal of the gate line, a common voltage signal is applied to the common voltage line to write the common voltage to the second terminal of the liquid crystal capacitor, the control signal output device acquires the data voltage that is provided by the data line to the pixel circuit and generates the corresponding charge control signal in accordance with the acquired data voltage; and S12, the control signal output device outputs the second control signal to the second switch control device, the second switch control device connects the first electrode of the charge power supply with the second terminal of the liquid crystal capacitor and connects the second electrode of the charge power supply with the first terminal of the liquid crystal capacitor under the control of the second control signal, so that the charge power supply reverse charges the liquid crystal capacitor, till the voltage difference between the first terminal and the second terminal of the liquid crystal capacitor becomes Vcom−Vdata;

S13, the control signal output device outputs the first control signal to the first switch control device, the first switch control device electrically connects the first electrode of charge power supply with the first terminal of the liquid crystal capacitor and electrically connects the second electrode of the charge power supply with the second terminal of the liquid crystal capacitor under the control of the first control signal, so that the charge power supply forward charges the liquid crystal capacitor, till the voltage difference between the first terminal and the second terminal of the liquid crystal capacitor becomes Vdata−Vcom;

the steps S12 and S13 are performed repeatedly, till the picture displayed by the display panel is updated.

It should be noted that, the corresponding descriptions of specific procedures of the steps S11, S12 and S13 have been given in the third embodiment, and will not be repeated here.

It should be understood that, the above embodiments are merely exemplary embodiments for explaining principle of the present invention, but the present invention is not limited thereto. Various modifications and improvements may be made by those ordinary skilled in the art within the spirit and essence of the present invention, these modifications and improvements fall into the protection scope of the present invention.

The invention claimed is:

1. A pixel circuit, comprising: a data write device, a liquid crystal capacitor, a power supply device and a control signal output device, wherein, the data write device is connected to a gate line, a data line and a first terminal of the liquid crystal capacitor, a second terminal of the liquid crystal capacitor is connected to a common voltage line, the control signal output device is connected to the data line and the power supply device, the power supply device is connected to the first terminal and the second terminal of the liquid crystal capacitor;

the data write device is configured to write a data voltage of the data line to the first terminal of the liquid crystal capacitor under the control of a gate scanning signal of the gate line in a normal display stage;

the control signal output device is configured to acquire the data voltage that is provided by the data line to the pixel circuit and generate a corresponding charge control signal in accordance with the acquired data voltage in the normal display stage, and transmit the charge control signal to the power supply device in a static display stage;

the power supply device is configured to charge the liquid crystal capacitor in accordance with the charge control signal, till a voltage difference between the first terminal and the second terminal of the liquid crystal capacitor is equal to a difference between the data voltage and a common voltage output from the common voltage line.

2. The pixel circuit of claim 1, wherein, the power supply device comprises a first switch control device and a charge power supply, the charge control signal comprises a first control signal;

the first switch control device is connected to the control signal output device, the first terminal and the second terminal of the liquid crystal capacitor, and a first electrode and a second electrode of the charge power supply;

the first switch control device is configured to connect the first electrode of the charge power supply with the first terminal of the liquid crystal capacitor and connect the second electrode of the charge power supply with the second terminal of the liquid crystal capacitor under the control of the first control signal, so as to forward charge the liquid crystal capacitor by the charge power supply, till the voltage difference between the first terminal and the second terminal of the liquid crystal capacitor is equal to the difference between the data voltage and the common voltage output from the common voltage line;

there is a constant voltage difference between the first electrode and the second electrode of the charge power supply.

3. The pixel circuit of claim 2, wherein, the first switch control device comprises a first transistor and a second transistor;

a control electrode of the first transistor is connected to the control signal output device, a first electrode of the first transistor is connected to the first electrode of the charge power supply, a second electrode of the first transistor is connected to the first terminal of the liquid crystal capacitor;

a control electrode of the second transistor is connected to the control signal output device, a first electrode of the second transistor is connected to the second electrode of the charge power supply, and the second electrode of the second transistor is connected to the second terminal of the liquid crystal capacitor.

4. The pixel circuit of claim 2, wherein, the power supply device further comprises a second switch control device, the charge control signal further comprises a second control signal;

the second switch control device is connected to the control single output device, the first terminal and the second terminal of the liquid crystal capacitor, and the first electrode and the second electrode of the charge power supply;

the second switch control device is configured to connect the first electrode of the charge power supply with the second terminal of the liquid crystal capacitor and connect the second electrode of the charge power supply with the first terminal of the liquid crystal capacitor under the control of the second control signal, so as to reverse charge the liquid crystal capacitor by the charge power supply, till the voltage difference between the first terminal and the second terminal of the liquid crystal capacitor is equal to the difference between the common voltage and the data voltage.

5. The pixel circuit of claim 4, wherein, the second switch control device comprises a third transistor and a fourth transistor;

a control electrode of the third transistor is connected to the control signal output device, a first electrode of the third transistor is connected to the first electrode of the charge power supply, a second electrode of the third transistor is connected to the second terminal of the liquid crystal capacitor;

a control electrode of the fourth transistor is connected to the control signal output device, a first electrode of the fourth transistor is connected to the second electrode of the charge power supply, and the second electrode of the fourth transistor is connected to the first terminal of the liquid crystal capacitor.

6. The pixel circuit of claim 4, wherein, the control signal output device is configured to output the first control signal to the first switch control device and output the second control signal to the second switch control device alternatively.

7. The driving method for driving the pixel circuit of claim 4, wherein, in the static display stage, the driving method comprises:

the control signal output device outputs the second control signal to the second switch control device, the second switch control device connects the first electrode of the charge power supply with the second terminal of the liquid crystal capacitor and connects the second electrode of the charge power supply with the first terminal of the liquid crystal capacitor under the control of the second control signal, so that the charge power supply reverse charges the liquid crystal capacitor, till the voltage difference between the first terminal and the second terminal of the liquid crystal capacitor is equal to the difference between the common voltage and the data voltage;

the control signal output device outputs the first control signal to the first switch control device, the first switch control device connects the first electrode of charge power supply with the first terminal of the liquid crystal capacitor and connects the second electrode of the charge power supply with the second terminal of the liquid crystal capacitor under the control of the first control signal, so that the charge power supply forward charges the liquid crystal capacitor, till the voltage difference between the first terminal and the second terminal of the liquid crystal capacitor is equal to the difference between the data voltage and the common voltage;

the control signal output device outputs the second control signal to the second switch control device and outputs the first control signal to the first switch control device alternatively.

8. The pixel circuit of claim 2, wherein, the power supply device further comprises a filter capacitor, a first terminal of the filter capacitor is connected to the first electrode of the charge power supply, and a second terminal of the filter capacitor is connected to the second electrode of the charge power supply.

9. The pixel circuit of claim 2, wherein, the charge power supply is a photocell.

10. The pixel circuit of claim 1, wherein, the data write device comprises a fifth transistor;

a control electrode of the fifth transistor is connected to the gate line, a first electrode of the fifth transistor is connected to the data line, and a second electrode of the fifth transistor is connected to the first terminal of the liquid crystal capacitor.

11. The pixel circuit of claim 10, wherein, the data write device further comprises a storage capacitor;

a first terminal of the storage capacitor is connected to the first terminal of the liquid crystal capacitor, and a second terminal of the storage capacitor is connected to the second terminal of the liquid crystal capacitor.

12. The pixel circuit of claim 1, further comprising a switch device provided between the power supply device and the first terminal of the liquid crystal capacitor or provided between the power supply device and the second terminal of the liquid crystal capacitor;

the switch device is configured to control electrical connection or electrical disconnection of the power supply device and the liquid crystal capacitor.

13. The pixel circuit of claim 12, wherein, the switch device comprises a sixth transistor;

a control electrode of the sixth transistor is connected to a switch control signal line, a first electrode of the sixth transistor is connected to the power supply device;

when the switch device is provided between the power supply device and the first terminal of the liquid crystal capacitor, a second electrode of the sixth transistor is connected to the first terminal of the liquid crystal capacitor; and when the switch device is provided between the power supply device and the second terminal of the liquid crystal capacitor, the second electrode of the sixth transistor is connected to the second terminal of the liquid crystal capacitor.

14. The pixel circuit of claim 1, wherein, the control signal output device comprises a data acquisition device and a signal output device;

the data acquisition device is connected to the data line and the signal output device, the signal output device is connected to the power supply device;

the data acquisition device is configured to acquire the data voltage provided by the data line to the pixel circuit;

the signal output device is configured to inquire about the charge control signal corresponding to the data voltage in accordance with a pre-stored correspondence relationship table.

15. A driving method for driving the pixel circuit of claim 1, the driving method comprises:

in the normal display stage, the data write device writes the data voltage of the data line to the first terminal of the liquid crystal capacitor under the control of the gate scanning signal of the gate line, a common voltage signal is applied to the common voltage line to write the common voltage to the second terminal of the liquid crystal capacitor, the control signal output device acquires the data voltage that is provided by the data line to the pixel circuit and generates the corresponding charge control signal in accordance with the acquired data voltage; and in the static display stage, the gate line stops outputting the gate scanning signal, the common voltage line is stopped to be applied with the common voltage signal, the power supply device charges the liquid crystal capacitor in accordance with the charge control signal, till the voltage difference between the first terminal and the second terminal of the liquid crystal capacitor is equal to the difference between the data voltage and the common voltage output from the common voltage line.

* * * * *